US010738434B1

(12) United States Patent
Currey

(10) Patent No.: US 10,738,434 B1
(45) Date of Patent: Aug. 11, 2020

(54) VIBRATORY COMPACTOR

(71) Applicant: Albert Ben Currey, Phoenix, AZ (US)

(72) Inventor: Albert Ben Currey, Phoenix, AZ (US)

( * ) Notice: Subject to any disclaimer, the term of this patent is extended or adjusted under 35 U.S.C. 154(b) by 0 days.

(21) Appl. No.: 16/691,240

(22) Filed: Nov. 21, 2019

(51) Int. Cl.

| | |
|---|---|
| ***E01C 19/30*** | (2006.01) |
| ***E02D 3/046*** | (2006.01) |
| ***E02F 3/96*** | (2006.01) |
| ***B06B 1/18*** | (2006.01) |
| ***E02F 5/22*** | (2006.01) |

(52) U.S. Cl.
CPC ..... *E02D 3/046* (2013.01); *B06B 1/183* (2013.01); *E01C 19/30* (2013.01); *E02F 3/967* (2013.01); *E02F 5/223* (2013.01); *B06B 2201/73* (2013.01)

(58) Field of Classification Search
CPC ..... E01C 19/30; E01C 19/32; E01C 19/34; E01C 19/35
USPC ..... 404/133.05, 133.1, 133.2, 113
See application file for complete search history.

(56) References Cited

U.S. PATENT DOCUMENTS 9,938,672 B2 * 4/2018 Beckhusen ..... E02D 3/046
9,988,770 B1 * 6/2018 Beckhusen ..... E01C 19/34

FOREIGN PATENT DOCUMENTS

KR 10-2011-0111681 * 10/2011

OTHER PUBLICATIONS

Machine Translation of Korean document KR20110111681A, pp. 8 (Year: 2011).*

* cited by examiner

*Primary Examiner* — Sunil Singh
(74) *Attorney, Agent, or Firm* — Schmeiser, Olsen & Watts LLP

(57) ABSTRACT

A vibratory compactor is provided. The vibratory compactor may include a compactor plate, a frame coupled to the compactor plate, wherein the frame may include an inner space and a housing. The frame may include a plurality of mounting brackets coupled between a first side member and a second side member of the frame. The vibratory compactor may include a vibration generation device coupled to the compactor plate within the inner space of the frame. The vibratory compactor may include a plurality of isolators, each isolator coupled to one mounting bracket of the plurality of mounting brackets. The housing may be coupled to the plurality of isolators, wherein the housing may include couplers removably coupled to a top surface of the housing. The couplers may be configured for coupling the vibratory compactor to an excavator type vehicle.

17 Claims, 11 Drawing Sheets

VIBRATORY COMPACTOR

BACKGROUND OF THE INVENTION

Technical Field

This invention relates generally to a compactor and more particularly to a vibratory compactor for use with excavator type vehicles.

State of the Art

Vibratory plate compactors are designed to compact lose material, such as soil, gravel, small aggregate, asphalt and so forth. Conventional plate compactors include a heavy plate on the bottom of the machine that moves up and down quickly. The combination of rapid impacts, plate weight and impact forces the soil underneath to compact or pack together more tightly. These plate compactors can be powered by gas engines or by hydraulic motors. Plate compactors that operate with hydraulic fluid are typically used with excavators or back hoes as an attachment. However, these hydraulic plate compactors are limited in their capability because the exposed hoses and further are not true vibratory compactors but have cyclic up and down motions wherein the amplitude of the up and down motion and the weight of the plate combine for the compaction. Often, these vibratory compactors cannot and should not sustain extra forces applied by the arm of the excavator or backhoe, but rather rest on the surface and the plate performs the function.

Accordingly, there is a need for an improved vibratory compactor for use with excavator type vehicles.

SUMMARY OF THE INVENTION

An embodiment includes a vibratory compactor comprising: a compactor plate; a frame coupled to the compactor plate, wherein the frame comprises: a first side member spaced apart from a second side member; a plurality of mounting brackets coupled between the first side member and the second side member; and an inner space bound by the first side member, the second side member, and the compactor plate; a vibration generation device coupled to the compactor plate within the inner space of the frame; a plurality of isolators, each isolator coupled to one mounting bracket of the plurality of mounting brackets, wherein a portion of each isolator is within the inner space and a portion extends beyond edges of the first side member and the second side member; and a housing coupled to the plurality of isolators thereby coupling the housing the frame with the frame within an inner volume of the housing, wherein the housing comprises couplers removably coupled to a top surface of the housing, the coupler configured for coupling the vibratory compactor to an excavator type vehicle.

Another embodiment includes a method of using a vibratory compactor, the method comprising: coupling the vibratory compactor to an excavator, the vibratory compactor comprising: a compactor plate; a frame coupled to the compactor plate, wherein the frame comprises: a first side member spaced apart from a second side member; a plurality of mounting brackets coupled between the first side member and the second side member; and an inner space bound by the first side member, the second side member, and the compactor plate; a vibration generation device coupled to the compactor plate within the inner space of the frame; a plurality of isolators, each isolator coupled to one mounting bracket of the plurality of mounting brackets, wherein a portion of each isolator is within the inner space and a portion extends beyond edges of the first side member and the second side member; and a housing coupled to the plurality of isolators thereby coupling the housing the frame with the frame within an inner volume of the housing, wherein the housing comprises couplers removably coupled to a top surface of the housing, the coupler configured for coupling the vibratory compactor to an excavator type vehicle; operating the vibration generation device to vibrate the compactor plate and the frame; applying force to the compactor plate from the excavator type vehicle in response to the excavator type vehicle applying force to the housing; and compacting material contacted by the compactor plate.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

Figure 1:
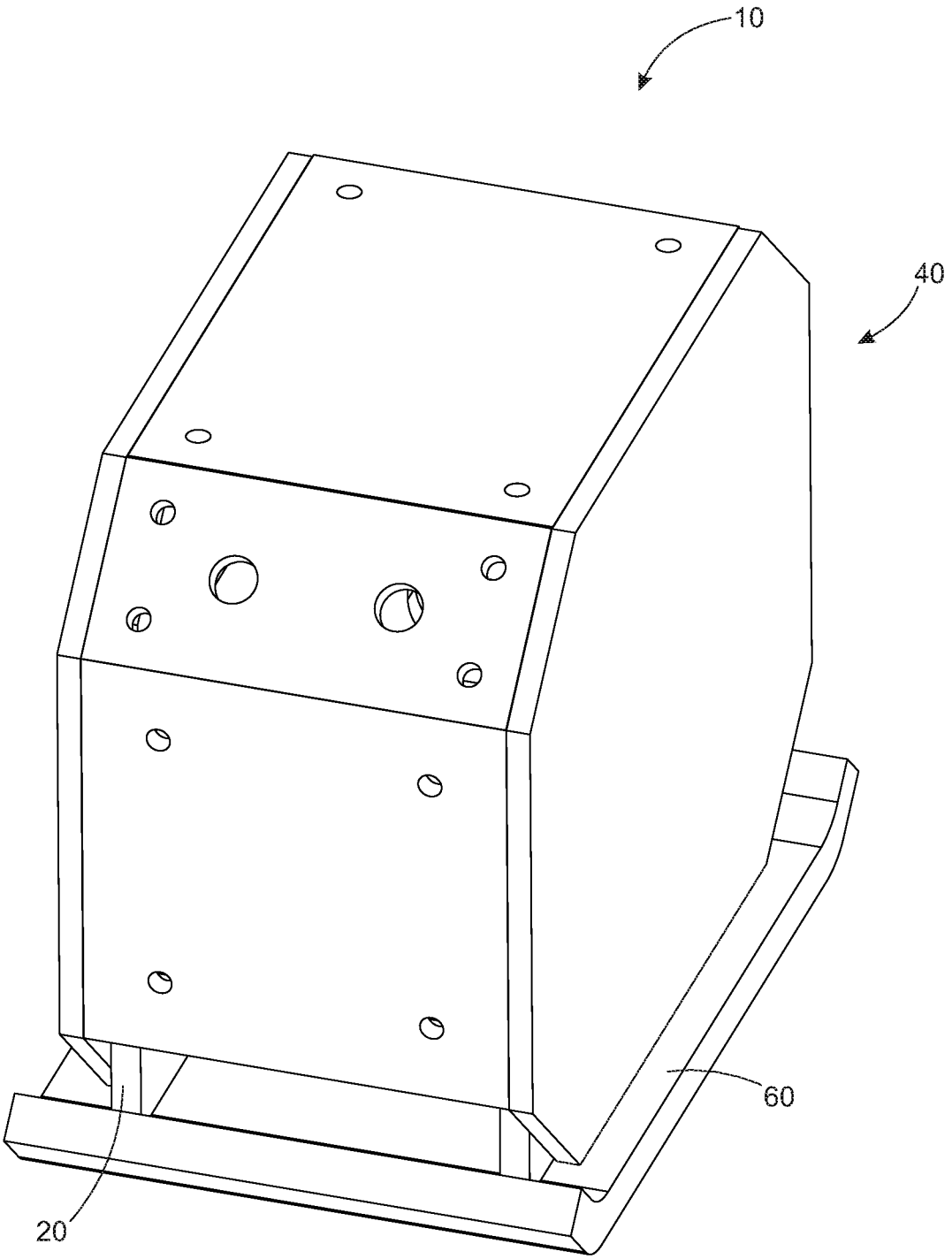
FIG. 1 is a perspective view of a vibratory compactor in accordance with an embodiment.
Figure 2:
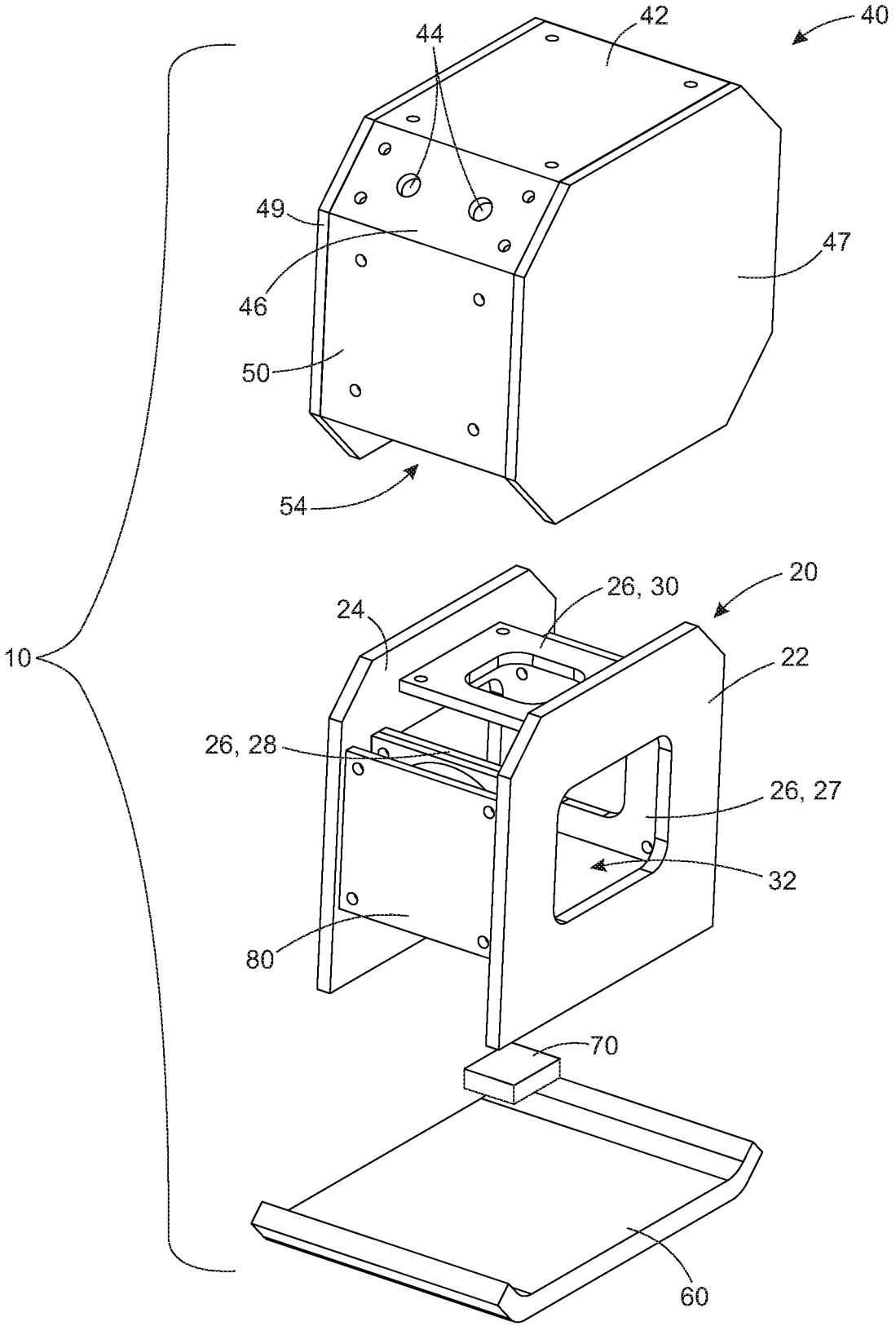
FIG. 2 is a partially exploded perspective view of a vibratory compactor in accordance with an embodiment.
Figure 3:
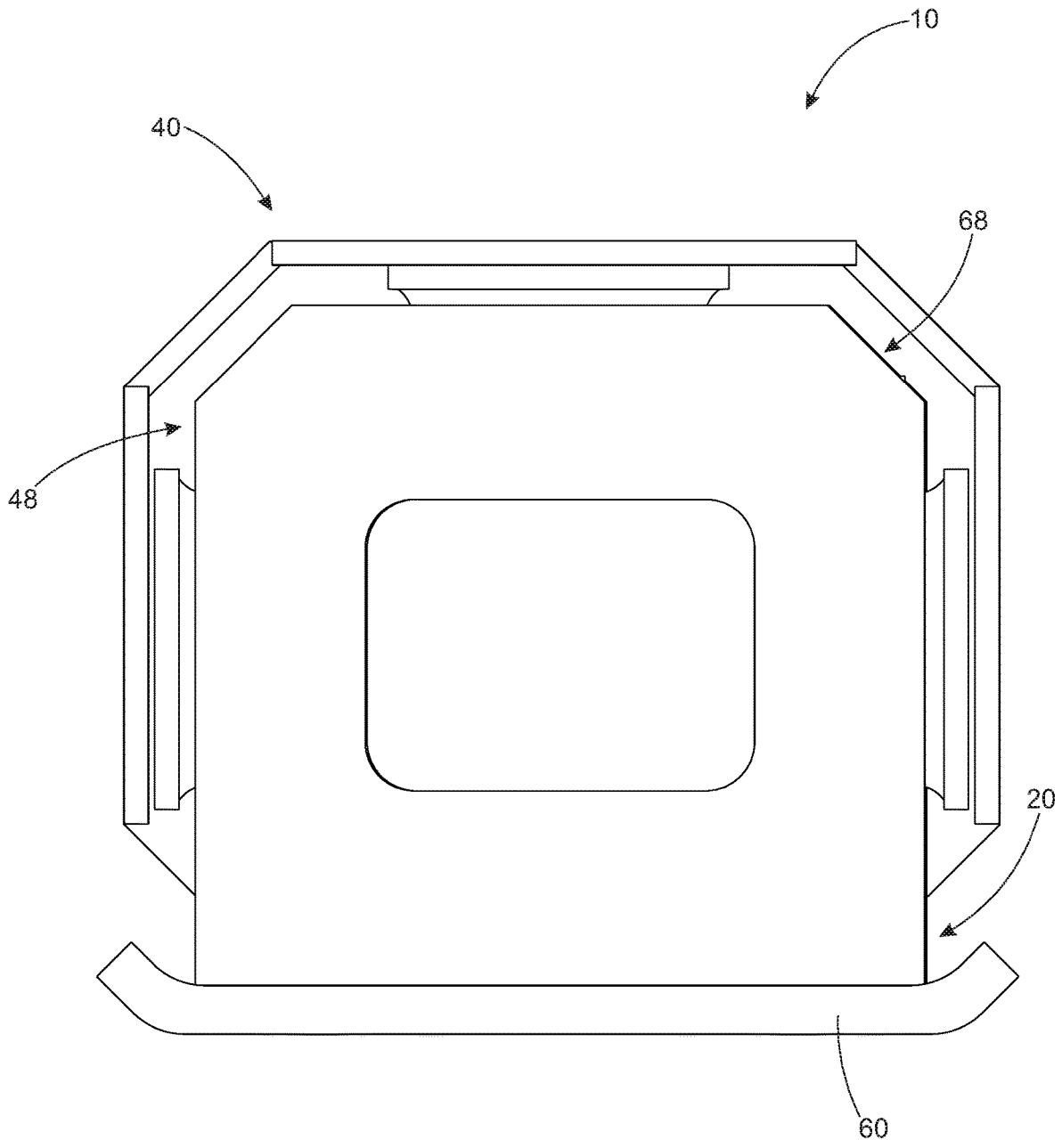
FIG. 3 is a side view with a side member of a housing removed from a vibratory compactor in accordance with an embodiment.
Figure 4:
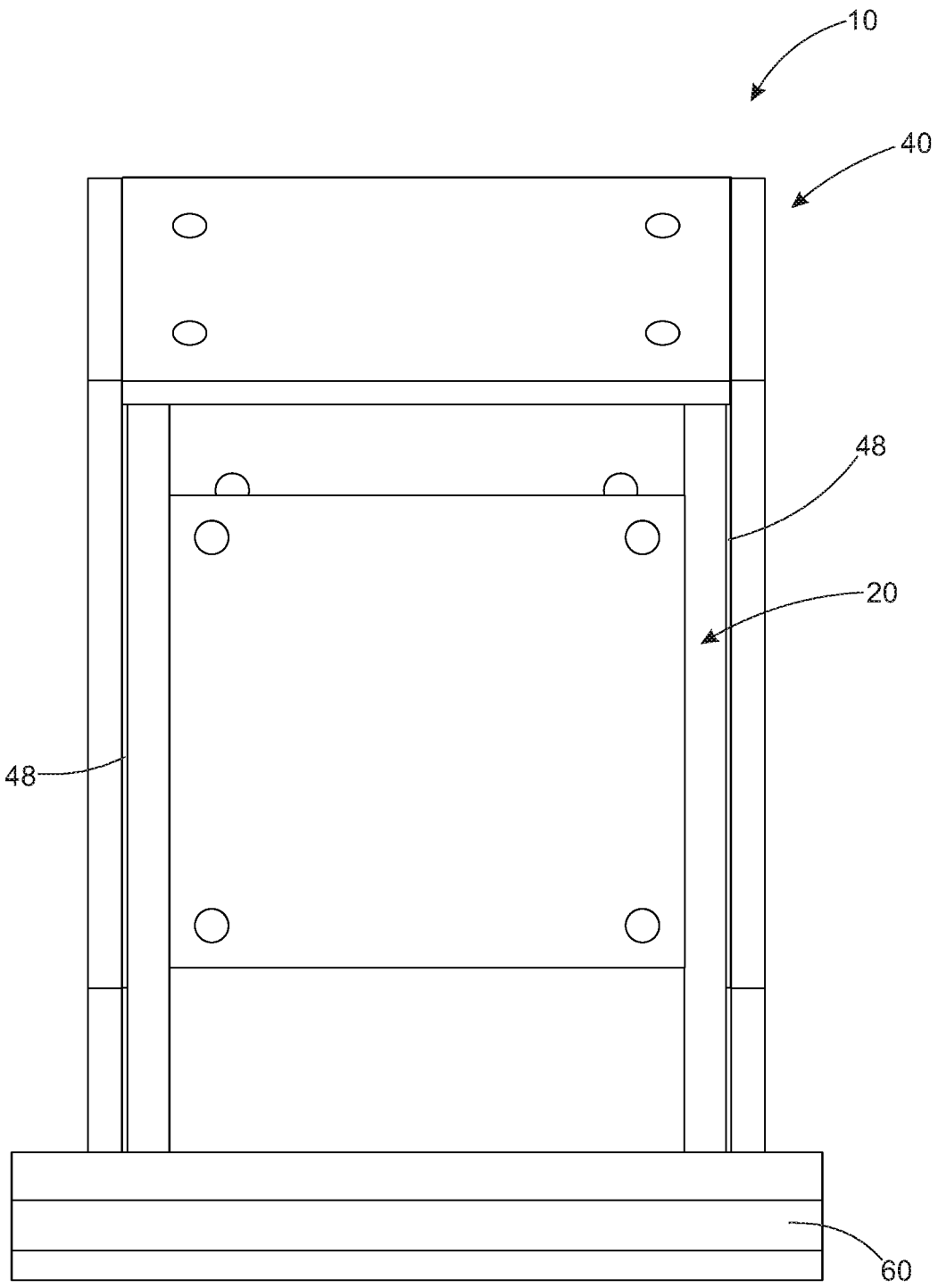
FIG. 4 is a front view with a front member of a housing removed from a vibratory compactor in accordance with an embodiment.
Figure 5:
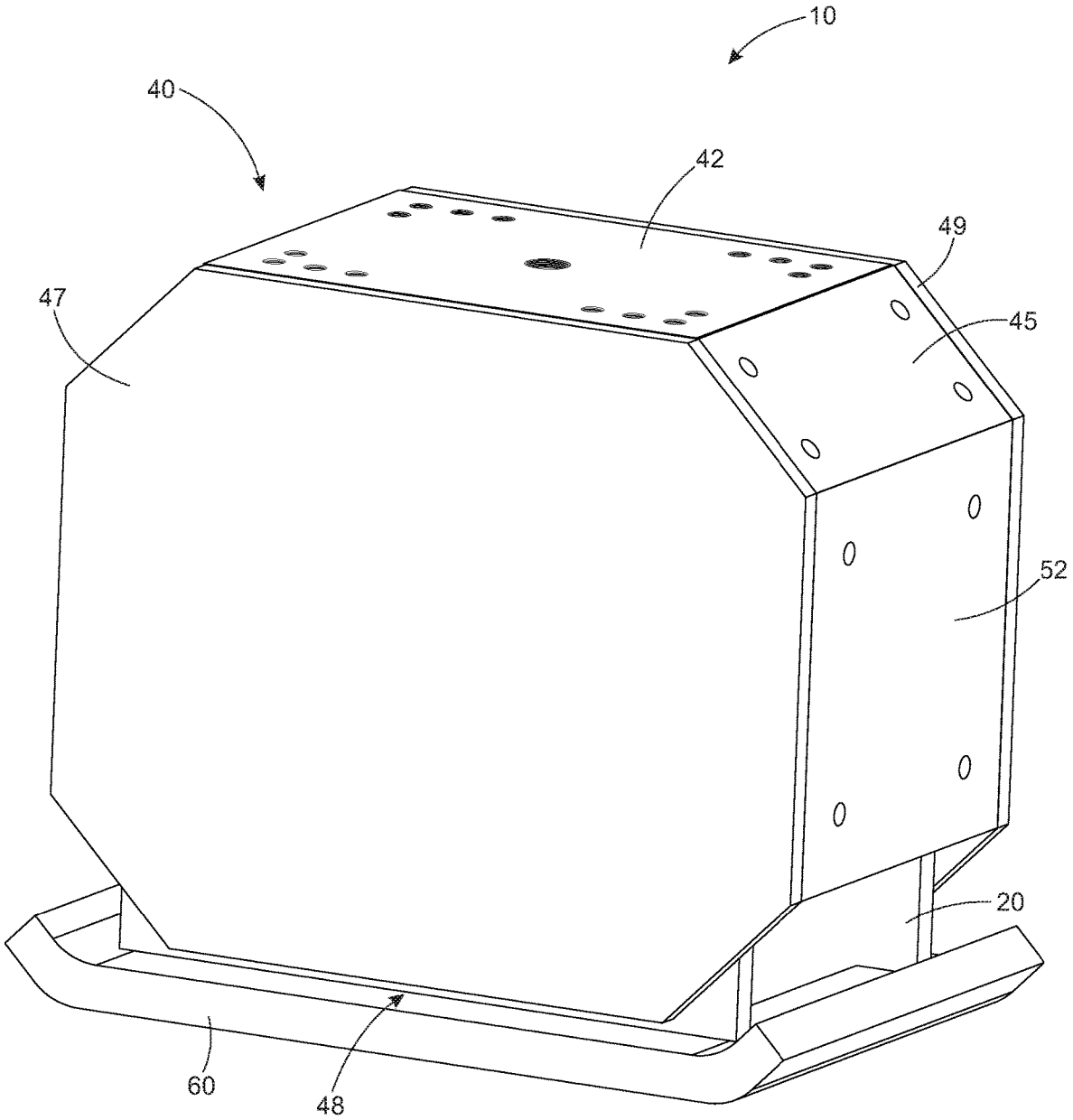
FIG. 5 is another perspective view of a vibratory compactor in accordance with an embodiment.
Figure 6:
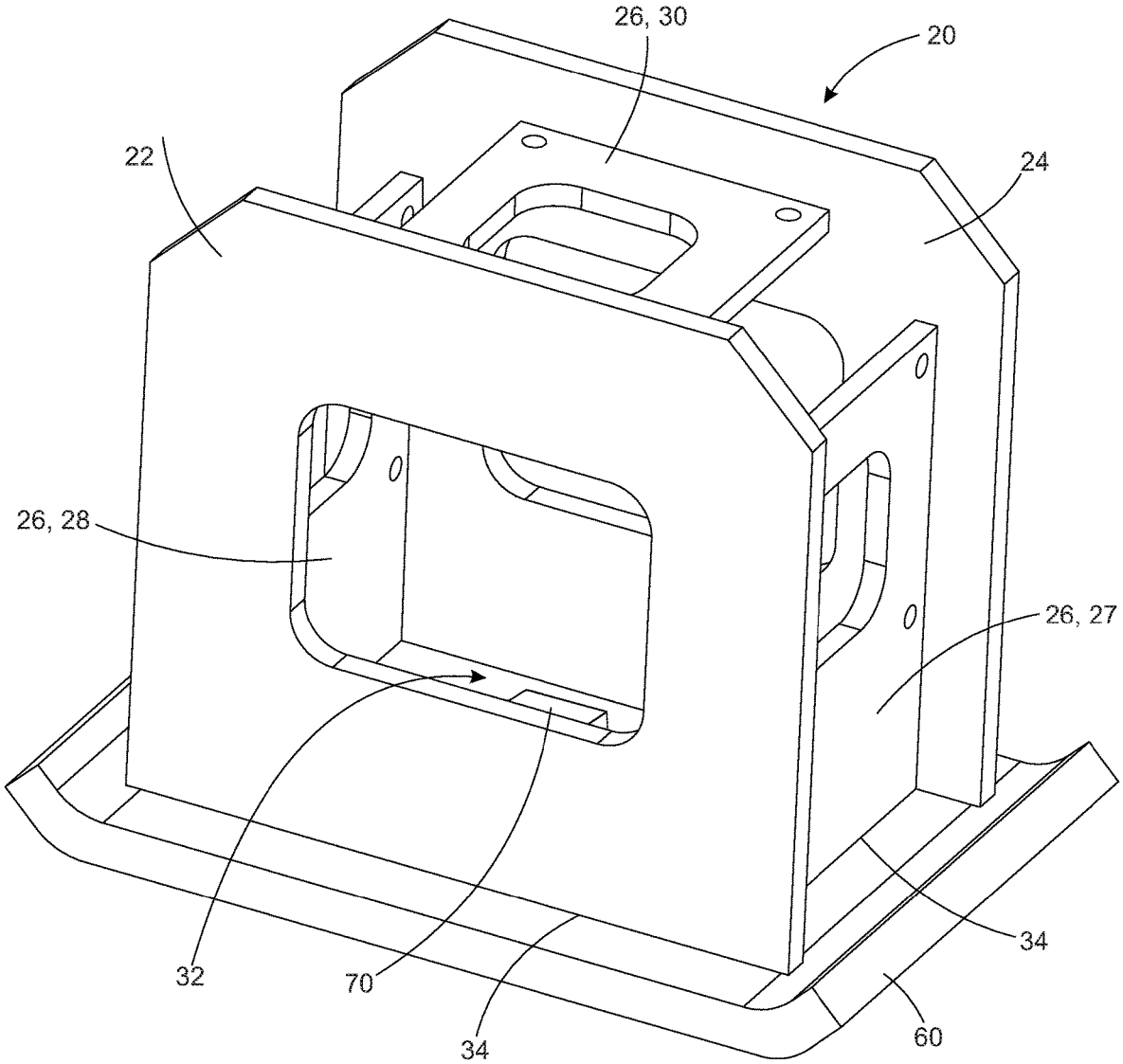
FIG. 6 is a perspective view of a vibratory compactor with the housing removed in accordance with an embodiment.
Figure 7:
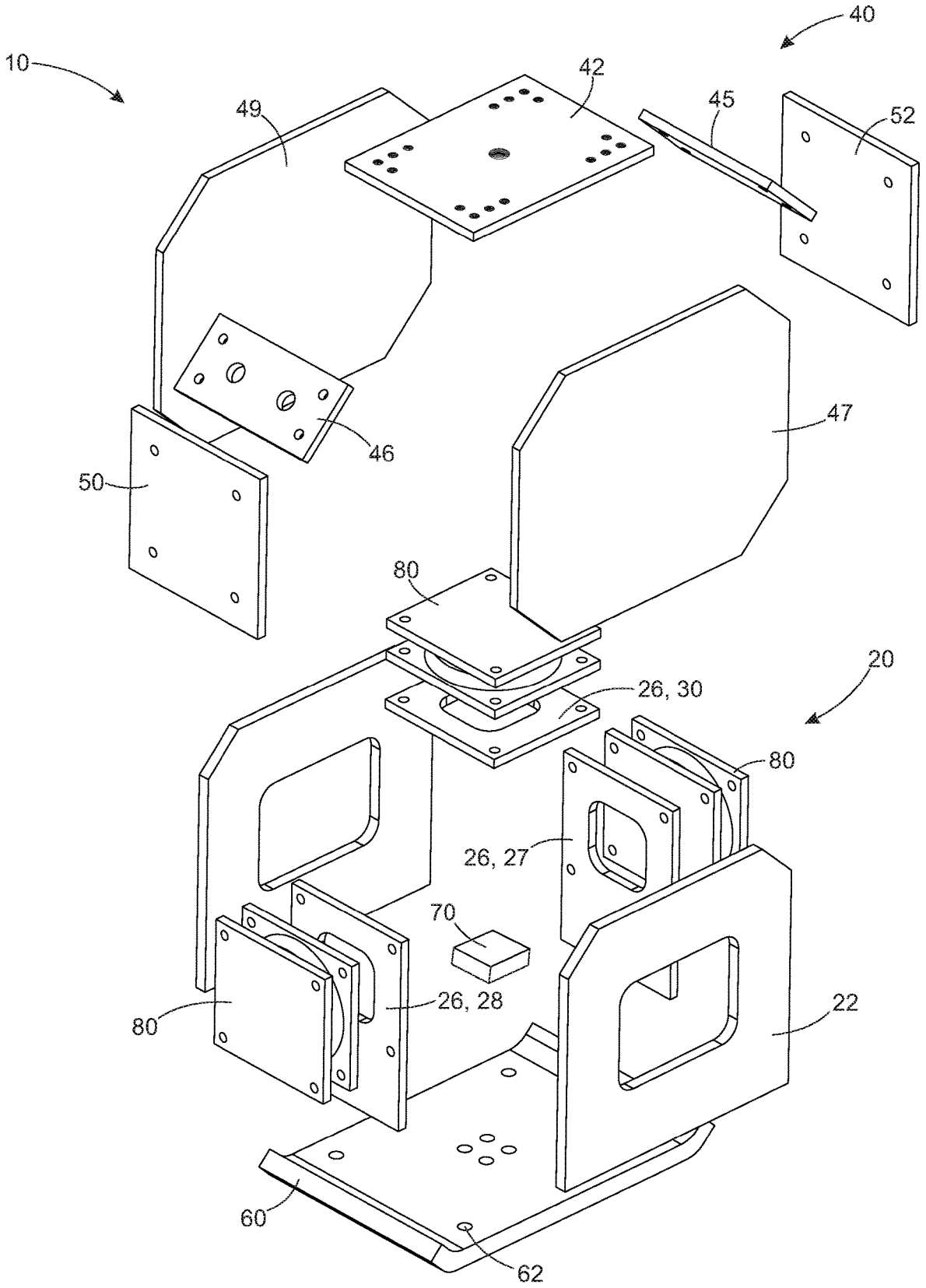
FIG. 7 is a fully exploded perspective view of a vibratory compactor in accordance with an embodiment.

As discussed above, embodiments of the present invention relate to a vibratory compactor for use with an excavator type vehicle. An excavator type vehicle may be an excavator, a backhoe, a mini-excavator or the like.

Referring to FIGS. 1-7, an embodiment of a vibratory compactor 10 is shown. The compactor 10 comprises a frame 20, a housing 40, a compactor plate 60 and a vibration generation device 70. The frame 20 comprises a first side member 22 spaced apart from a second side member 24. The frame 20 may further comprise a plurality of mounting brackets 26 coupled between the first side member 22 and the second side member 24, such as, but not limited to, a front mounting bracket 27, a rear mounting bracket 28, and a top mounting bracket 30, wherein the front and rear mounting brackets 27 and 28 are coupled between the first and second side members 22 and 24 and parallel to each other. The top mounting bracket 30 may be coupled between the first and second side members 22 and 24 and perpendicular to the front and rear mounting brackets 27 and 28. It will be understood that various amounts of mounting brackets 26 and orientations of coupling the mounting brackets 26 between the first side member 22 and the second side member 24 may be utilized. Further, it will be understood that the number of mounting brackets 26 utilized may correspond with the size of the vibratory compactor 10. The frame 20 may further comprise an inner space 32 bound by the first side member 22, the second side member 24, and the compactor plate 60. The vibration generation device 70 may be coupled to the compactor plate 60 within the inner space 32 of the frame 20. In embodiments, the vibration generation device 70 may be coupled directly to the compactor plate 60. The compactor plate 60 may include apertures wherein a larger compactor plate may be coupled to a bottom of the compactor plate 60.

The housing 40 may include a top member 42, chamfered members 45 and 46, a first side member 47, a second side member 48, a rear member 50 and a front member 52 coupled together to form the housing 40 with an open end providing access to an inner volume 54. The opening and inner volume 54 are configured to receive the frame 20 within the inner volume 54 of the housing 40. All of the holes for coupling components to each may be tapped holes and comprise threads/. This allows for coupling of components together without the need of nuts. For example, and without limitation, the top member 42 of the housing 40 includes various amounts of threaded holes 43 that are configured to allow various sized couplers (ears) to be coupled to bolted to the top member 42 without the need for nuts. While threads are shown on the holes of the top member 42, it will be understood that all holes for coupling may comprise threads.

The vibratory compactor 10 may further comprise a plurality of isolators 80. Each isolator 80 may be coupled to one mounting bracket of the plurality of mounting brackets 26. A portion of each isolator 80 is within the inner space and a portion of each isolator 80 extends beyond edges of the first side member 22 and the second side member 24. The housing 40 may be coupled to the plurality of isolators 80, wherein the housing 40 comprises couplers 90 removably coupled to a top member 42 of the housing 40. The coupler 90 may be configured for coupling the vibratory compactor 10 to an excavator type vehicle.

In embodiments, the first side member 22 of the frame 20 may comprise an aperture 23 providing access to the inner space 32. The second side member 24 of the frame 20 may comprise an aperture 25 providing access to the inner space 32. Additionally, in some embodiments, the first side member 22, the second side member 24 and two of the plurality of mounting brackets 26 are coupled to the compactor plate 30 forming a dust/debris seal 34 to inhibit dust/debris from entering the inner space 32.

In embodiments, the vibration generation device 70 is a hydraulic vibration generation device. In these embodiments, the housing 40 may comprise apertures 44 configured for hydraulic hoses to extend therethrough from the excavator type vehicle to the hydraulic vibration generation device 70. In other embodiments, the housing 40 may comprise fittings configured for hydraulic hoses to extend between the excavator type vehicle and one side of the fittings and configured for hydraulic hoses to extend between an opposed side of the fittings and the hydraulic vibration generation device 70. The fittings may be located in the same place as the apertures 44. For example, the fittings may be coupled within the apertures 44.

In each of these embodiments, the apertures 44 are located toward a top of the housing 40 and not extending out of any of the sides of the housing 40. For example, the apertures 44 may be located in one of the upper chamfered members 45 or 46. The apertures located toward a top of the housing and not extending from the side, limits the opportunity for damage to the hoses or fittings. This is a distinction over prior art wherein prior art has hoses and fittings open to the environment and allows for damage to easily occur to the hoses and/or fittings. In embodiments of this invention, the fittings for hoses to the vibration generation device 70 are located within the inner space 32 of the frame 20 and the apertures 44 with or without fittings are located in an upper surface that limits damage that may occur during use. The configuration of the frame 20 and the housing 40 operate to protect the hoses and fittings for operation of the vibration generation device 70.

With additional reference to the isolators 80, the plurality of isolators 80 isolate the vibration of the compactor plate 60 and frame 20 from the housing 40. Additionally, the plurality of isolators 80 are oriented to allow forces to be applied to vibratory compactor 10 from operation of the excavator type vehicle in one or more directions comprising perpendicular to the compactor plate 60 and any angle to the compactor plate 20. The vibratory compactor 10 may further comprise a gap 48 between the housing 40 and the frame 20 and the housing 40 and the compactor plate 60, the gap 40 formed by the isolators 80.

The vibratory compactor 10 may further comprise a range of deflection of the plurality of isolators 80, wherein the range of deflection is defined by the distance of the gap 48 between the housing 40 and the frame 20 and the housing 40 and the compactor plate 60, wherein limits of the range of deflection are set by the housing 40 contacting the frame 20 and/or the compactor plate 60.

It will be understood that while one size of a vibratory compactor 10 is depicted in the drawings figure, the vibratory compactor may be made in any number of various sizes depending on the type of job and the size of excavator type vehicle may be using the vibratory compactor 10. In some embodiments, particularly as the size of the vibratory compactor increases, the gap 48 may be of a size that the vibratory compactor 10 may comprise a spacer between the frame 20 and the housing 40. The spacer may be formed of ultra high molecular weight polyethylene ("UHMW") or other type of material with comparable material attributes to UHMW. Typically, the spacer is located between the frame 20 and the first and second side members 47 and 48 of the housing 40. The spacer may operate as an additional debris seal.

Figure 9:
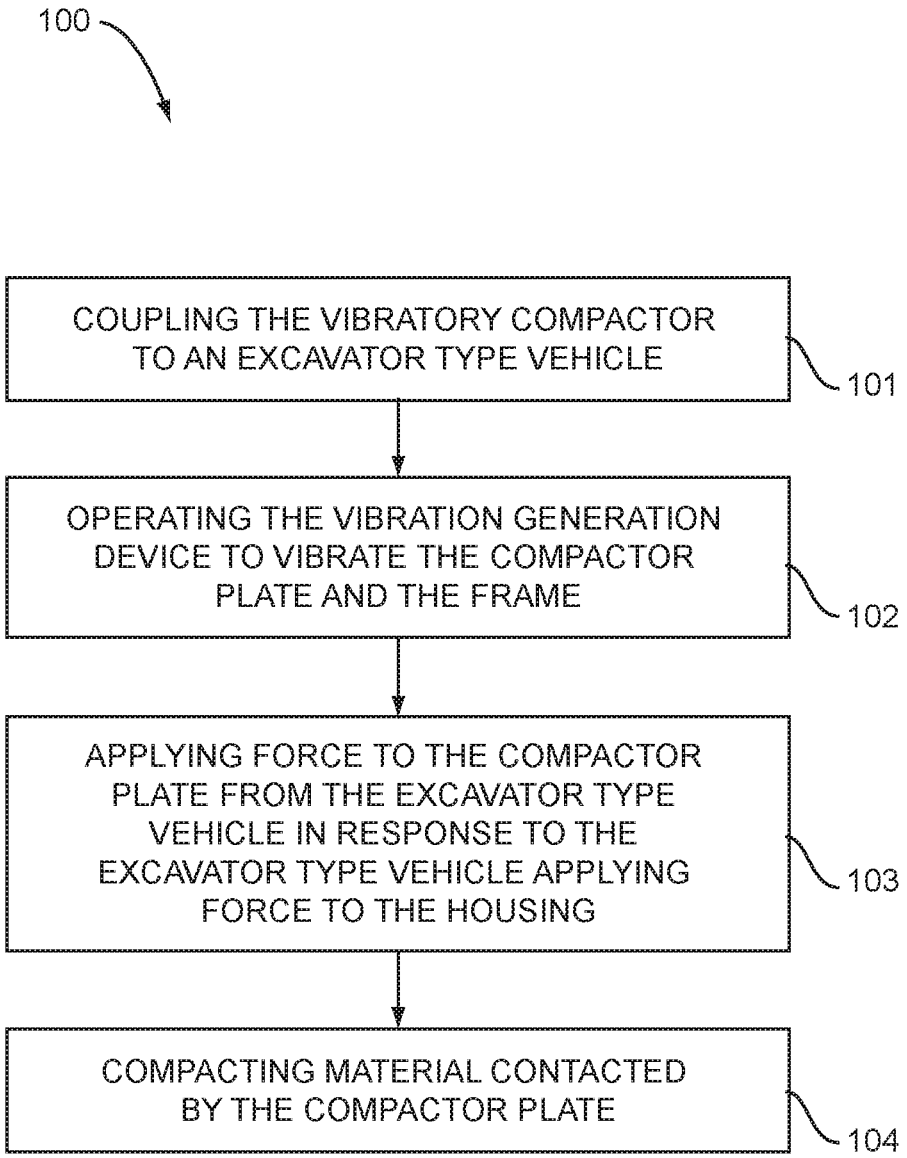
FIG. 9 is flow chart of a method of using a vibratory compactor in accordance with an embodiment.

Referring further to the drawings, FIG. 9 depicts a method 100 of using vibratory compactor. The method 100 may comprise coupling the vibratory compactor to an excavator (Step 101), wherein the vibratory compactor comprises the components as described above; operating the vibration generation device to vibrate the compactor plate and the frame (Step 102); applying force to the compactor plate from the excavator type vehicle in response to the excavator type vehicle applying force to the housing (Step 103); and compacting material contacted by the compactor plate (Step 104).

The method 100 may further comprise isolating vibration of the compactor plate and the frame from the housing. Additionally, the Step 102 of operating the vibration generation device may comprise flowing hydraulic fluid through the vibration generation device.

Figure 8A:
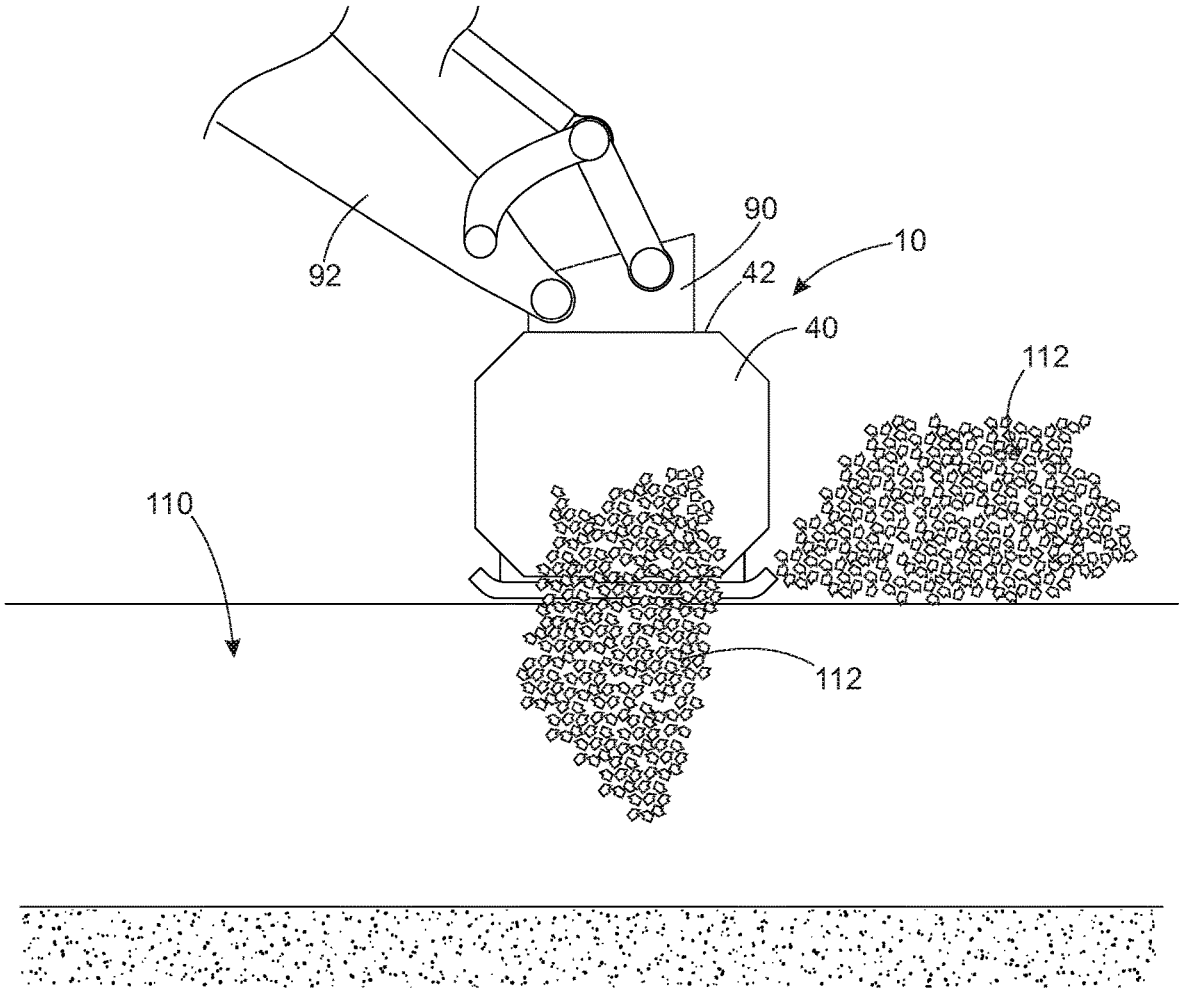
FIG. 8A is a side view of a ditch with a vibratory compactor moving material from a side of the ditch into the ditch in accordance with an embodiment.
Figure 8B:
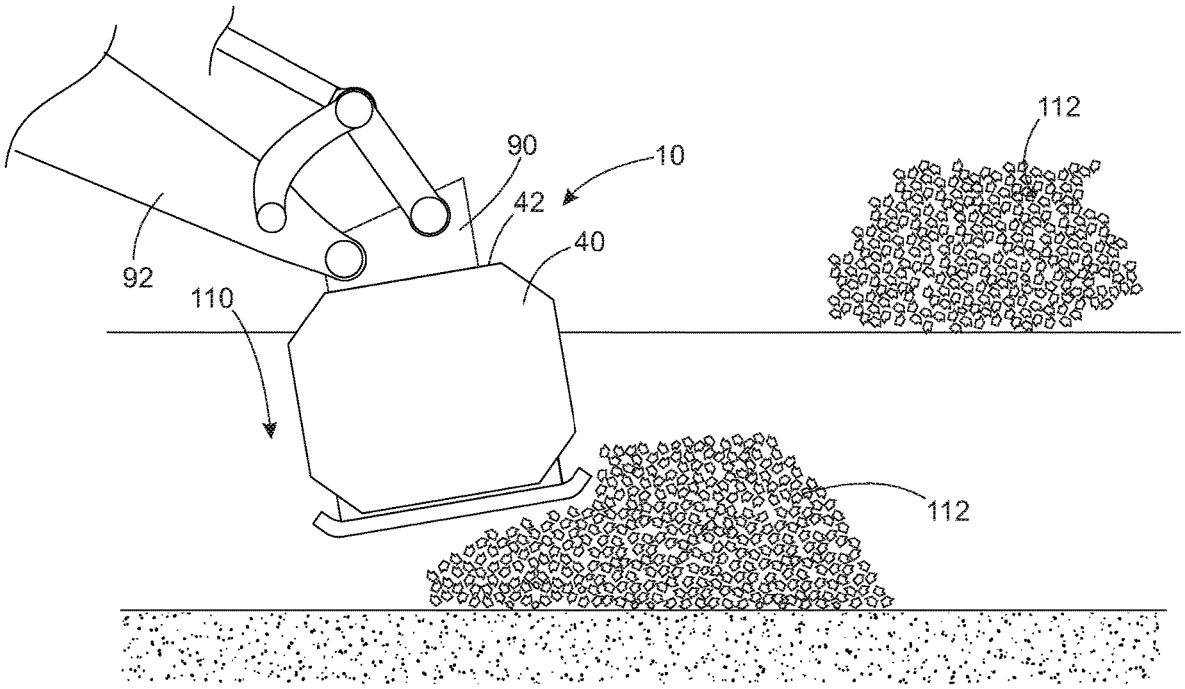
FIG. 8B is a side view of a ditch with a vibratory compactor moving material within the ditch in accordance with an embodiment.
Figure 8C:
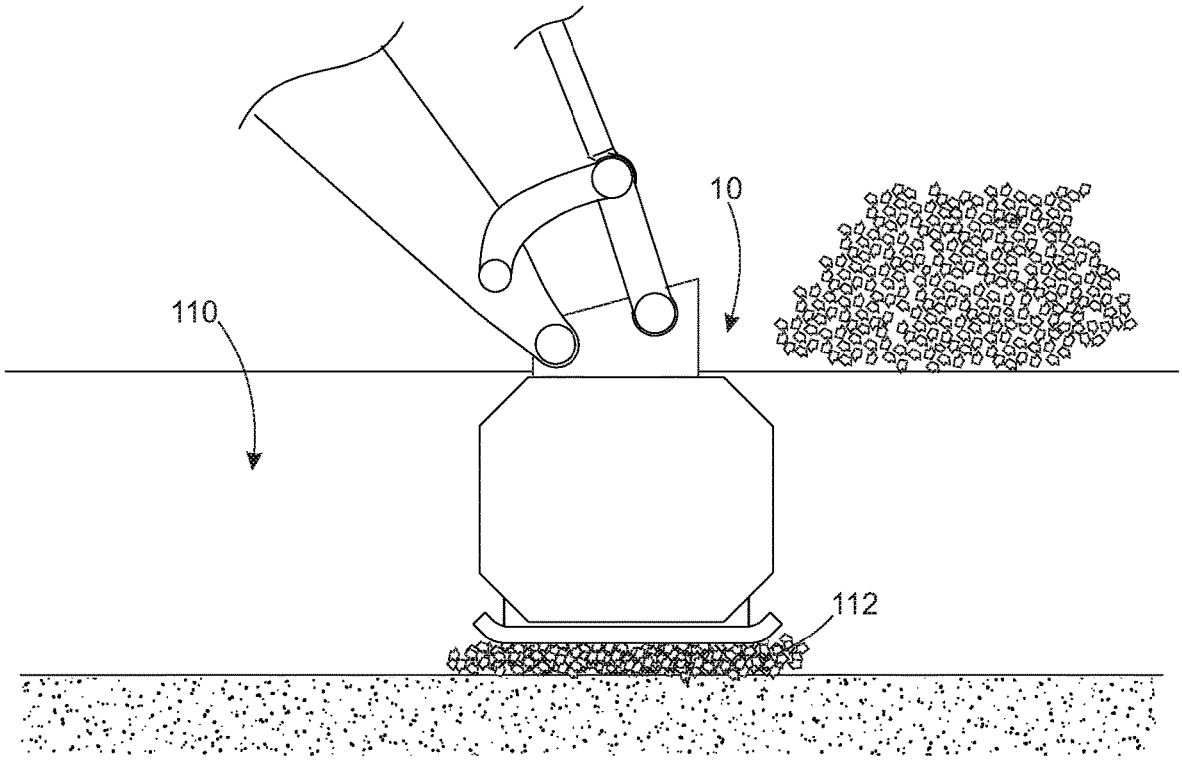
FIG. 8C is a side view of a ditch with a vibratory compactor compacting material within the ditch in accordance with an embodiment.

With further reference to FIGS. 8A-8C, the method of use may include moving material 112 from a first location to a second location, moving material in the second location and compacting material in the second location. For example and without limitation, a first location may be a side of a ditch 110 to a second location within the ditch 110 with the vibratory compactor 10 as shown in FIG. 8A; moving material within the ditch 110 with the vibratory compactor 10 as shown in FIG. 8B; and compacting the material 112 within the ditch 110 as depicted in FIG. 8C. In each instance the vibratory compactor 10 may utilize couplers 90 to couple to an arm 92 of an excavator type vehicle and operate to move or scrape material from a side of the ditch 110 into the ditch 110, move material within the ditch 110 and compact the material within the ditch 110. Conventional compactors do not have the ability to perform either of these functions because the hoses, fittings and motor are all exposed and subject to damage just by trying to compact within the ditch 110 and would definitely lack the ability to scrape material into the ditch.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A vibratory compactor comprising:

a compactor plate;

a frame coupled to the compactor plate, wherein the frame comprises:

a first side member spaced apart from a second side member;

a plurality of mounting brackets coupled between the first side member and the second side member; and an inner space bound by the first side member, the second side member, and the compactor plate;

a hydraulic vibration generation device coupled to the compactor plate within the inner space of the frame, the hydraulic vibration generation device comprising hydraulic hoses coupled to the vibration generation device;

a plurality of isolators, each isolator coupled to one mounting bracket of the plurality of mounting brackets, wherein a portion of each isolator is within the inner space and a portion extends beyond edges of the first side member and the second side member; and a housing having a top member, a first side member, a second side member, a rear member and a front member, the housing coupled to the plurality of isolators thereby coupling the housing to the frame with the frame within an inner volume of the housing, wherein the housing comprises couplers removably coupled to the top surface of the housing, the coupler configured for coupling the vibratory compactor to an excavator type vehicle, wherein the hydraulic hoses coupled to the hydraulic vibration generation device do not extend through the first side member of the housing, the second side member of the housing, the rear member of the housing or the front member of the housing.

2. The vibratory compactor of claim 1, wherein the first side member of the frame comprises an aperture providing access to the inner space.

3. The vibratory compactor of claim 1, wherein the second side member of the frame comprises an aperture providing access to the inner space.

4. The vibratory compactor of claim 1, wherein the first side member of the frame, the second side member of the frame and two of the plurality of mounting brackets of the frame are coupled to the compactor plate forming a debris seal to inhibit debris from entering the inner space.

5. The vibratory compactor of claim 1, wherein the housing comprises apertures configured for the hydraulic hoses to extend therethrough from the excavator type vehicle to the hydraulic vibration generation device.

6. The vibratory compactor of claim 1, wherein the housing comprises fittings configured for additional hydraulic hoses to extend between the excavator type vehicle and one side of the fittings and for the hydraulic hoses to extend between another side of the fittings and the hydraulic vibration generation device.

7. The vibratory compactor of claim 1, wherein the plurality of isolators isolate the vibration of the compactor plate and frame from the housing.

8. The vibratory compactor of claim 1, wherein the plurality of isolators are oriented to allow forces to be applied to the vibratory compactor from operation of the excavator type vehicle in one or more directions comprising perpendicular to the compactor plate and any angle to the compactor plate.

9. The vibratory compactor of claim 1, further comprising a gap between the housing and the frame and the housing and the compactor plate, the gap formed by the isolators.

10. The vibratory compactor of claim 9, further comprising a range of deflection of the plurality of isolators, wherein the range of deflection is defined by the distance of the gap between the housing and the frame and the housing and the compactor plate, wherein limits of the range of deflection are set by the housing contacting the frame and/or the compactor plate.

11. A method of using a vibratory compactor, the method comprising:

coupling the vibratory compactor to an excavator, the vibratory compactor comprising:

a compactor plate;

a frame coupled to the compactor plate, wherein the frame comprises:

a first side member spaced apart from a second side member;

a plurality of mounting brackets coupled between the first side member and the second side member; and an inner space bound by the first side member, the second side member, and the compactor plate;

a hydraulic vibration generation device coupled to the compactor plate within the inner space of the frame, the hydraulic vibration generation device comprising hydraulic hoses coupled to the vibration generation device;

a plurality of isolators, each isolator coupled to one mounting bracket of the plurality of mounting brackets, wherein a portion of each isolator is within the inner space and a portion extends beyond edges of the first side member and the second side member; and a housing having a top member, a first side member, a second side member, a rear member and a front member, the housing coupled to the plurality of isolators thereby coupling the housing to the frame with the frame within an inner volume of the housing, wherein the housing comprises couplers removably coupled to the top surface of the housing, the coupler configured for coupling the vibratory compactor to an excavator type vehicle, wherein the hydraulic hoses coupled to the hydraulic vibration generation device do not extend through the first side member of the housing, the second side member of the housing, the rear member of the housing or the front member of the housing;

operating the vibration generation device to vibrate the compactor plate and the frame;

applying force to the compactor plate from the excavator type vehicle in response to the excavator type vehicle applying force to the housing; and compacting material contacted by the compactor plate.

12. The method of claim 11, further comprising isolating vibration of the compactor plate and the frame from the housing.

13. The method of claim 11, wherein operating the vibration generation device comprises flowing hydraulic fluid through the vibration generation device.

14. The method of claim 11, further comprising moving material from a first location to a second location.

15. The method of claim 14, further comprising moving material at the second location.

16. The method of claim 15, further comprising compacting the material at the second location.

17. The method of claim 16, wherein the first location is a side of a ditch and the second location is within the ditch.

* * * * *